United States Patent [19]

Brown, Jr.

[11] 4,011,708

[45] Mar. 15, 1977

[54] BAG HANDLING APPARATUS

[75] Inventor: Fred P. Brown, Jr., Centerville, Mass.

[73] Assignee: Packaging Industries, Inc., Hyannis, Mass.

[22] Filed: Nov. 26, 1974

[21] Appl. No.: 527,360

[52] U.S. Cl. ..... 53/187; 53/384; 93/53 SD; 226/114; 271/132

[51] Int. Cl.[2] ..... B65B 5/00; B65B 43/26

[58] Field of Search ..... 53/183, 187, 384; 93/8 R, 535 D; 271/101, 99, 131, 132, 102, 194; 226/114

[56] References Cited

UNITED STATES PATENTS

| | | | |
|---|---|---|---|
| 1,979,153 | 10/1934 | Guenther | 271/102 |
| 2,378,306 | 6/1945 | Leonhart | 271/102 X |
| 2,645,477 | 7/1953 | Kaplan | 226/114 X |
| 2,899,786 | 8/1959 | Harker | 53/187 |
| 2,999,344 | 9/1961 | Clanin | 53/374 X |
| 3,074,326 | 1/1963 | Engleson et al. | 93/53 S D |
| 3,081,014 | 3/1963 | Anderson et al. | 226/114 X |
| 3,197,936 | 8/1965 | Messmer | 53/187 X |
| 3,340,679 | 9/1967 | Johnson | 53/187 X |
| 3,381,446 | 5/1968 | Marchand | 53/187 |
| 3,390,875 | 7/1968 | Beert | 271/132 X |
| 3,618,282 | 11/1971 | Hagel | 53/183 X |
| 3,717,536 | 2/1973 | McVay | 93/8 R X |
| 3,727,373 | 4/1973 | MacLeod | 53/183 |
| 3,783,752 | 1/1974 | Langen | 93/53 S D |
| 3,812,649 | 5/1974 | Clancy | 53/187 |
| 3,855,907 | 12/1974 | Johnson | 53/183 X |

*Primary Examiner*—Travis S. McGehee
*Assistant Examiner*—J. Sipos
*Attorney, Agent, or Firm*—Brumbaugh, Graves, Donohue & Raymond

[57] ABSTRACT

Apparatus is described for facilitating the filling and sealing of bags for shipping or mailing. The bag supply preferably is in web or strip form, i.e. the bags are joined along successive closed sides of the bags to form a continuous web with the bag bottoms along one edge and the unsealed bag top ends along the other edge of the web. Means are provided to advance the web one bag length each cycle to a cutting station which severs the bag from the web. A vacuum picker and pusher bar convey the separated bag from the cutting station to a carrier comprised of a series of continuously moving chains having lugs between which the bags are first inserted and then retained for travel with the chains. The pusher bar and the spacing between the lugs cooperate to maintain the unsealed end of the bag open sufficiently to receive an article inserted while the bag is moved by the carrier. At the end of the carrier run, sealing means close the open end of the bag. The entire operation is controlled by a motor driven cam programmer and indexed by a photocell arrangement which detects indexing marks imprinted on the bags.

4 Claims, 12 Drawing Figures

10
11
12
20
30
32
33
37
38
39
40
41
42
43
44
103
110
112
114
116
118
VI

BAG HANDLING APPARATUS

BACKGROUND OF THE INVENTION

The present invention relates to bag handling apparatus and, more particularly, to apparatus for separating individual bags from a web, opening an end of the separated bag for receiving an article in the bag, carrying the opened bag past an article inserting station, and sealing the opened end of the bag.

Bags, particularly of the padded or cushioned type have found wide acceptance for packaging and shipping articles. One reason for this acceptance is that bags may be readily made from relatively inexpensive flexible sheet material such as paper, plastic, or cloth. Another important reason is that bags readily adapt to accommodate a variety of differently sized and shaped articles.

One type of shipping bag or envelope which has enjoyed success is disclosed in copending U.S. Pat. Application Ser. No. 419,923 filed Nov. 29, 1973, now abandoned, in the names of Bambara and Knaus, and assigned to the present assignee. The bag disclosed in this application is an improved cushioned shipping bag of a type used for mailing or shipping articles such as books or machine parts which may be damaged if not protected by the cushion or padding of the bag. The improved cushioned shipping bag has a continuous layer of foamed plastic sheet material firmly secured to a continuous layer of relatively thin paper or other material forming an outer surface of the finished, laminated bag.

An improvement on the foregoing shipping bag is disclosed in copending U.S. patent application Ser. No. 473,060 filed May 23, 1974, now abandoned, in the names of Bambara and Strzelewicz, and also assigned to the present assignee. The bag disclosed in this application is a cushioned shipping bag formed from a continuous layer of foamed plastic sheet material firmly secured to a continuous layer of a relatively thin paper or other material forming an outer surface of the finished, laminated bag. In forming this bag, the laminated bag material is folded at one edge in such a way as to form a cushioned flap at an opposite edge which is not closed or sealed to permit articles to be put in the bag. The flap may be later folded onto the bag and secured to the bag by, for example, pressure sensitive adhesive placed in a strip along the unclosed edge of the bag.

There are, of course, many other types of bags, both padded and unpadded and of a variety of materials, employed for packaging. While bags have many salutary features, they suffer from the major drawback of being relatively difficult to fill and seal, especially when the articles to be bagged are of non-uniform shape and size. Generally, the filling and sealing are done by hand, the bagger taking a bag from a stack, inserting a hand into the unsealed end to spread the sides, inserting the articles, and then sealing the open end. In mass shipping operations, such as book clubs where thousands of articles are shipped in bags on a periodic basis, these manual operations become particularly slow and expensive.

SUMMARY OF THE INVENTION

The present invention overcomes the foregoing disadvantages of conventional bagging operations by eliminating most of the manual steps. The apparatus automatically and at a rapid rate severs the individual bags from a continuous web of bags, conveys the severed bags to a carrier which maintains the bags upright with an open end while moving them along a predetermined path or run past an article insertion station where articles may be manually or automatically inserted in the bags, and finally seals the open ends of the bags.

The shipping bags disclosed in the aforementioned copending applications of the present assignee lend themselves particularly well to use with the present invention in that they are readily manufacturable in a continuous strip or web simply by eliminating the separation step of the manufacturing processes disclosed in the applications. The result is a web of unseparated bags connected at successive sides and with their closed bottoms along one edge of the web and their unsealed top ends along the other edge. The web may be coiled or folded in accordion style to provide a supply or magazine of bags for use with the present invention.

In accordance with the present invention, a pair of motor driven nip rolls advances the bag web past a photocell disposed in registry with the line of advance of appropriate index marks imprinted one on each of the bags on the web. Upon detection of an index mark, the web advance is stopped with the connected side of the preceding bag now being in registry with a knife in a cutting station for severing it from the web. At the appropriate time in a cycle of operation, the knife is actuated to sever the bag which, in the meantime, has been gripped between a vacuum retracting arm or picker and a backing plate. After the cutting, the picker retracts, moving the severed bag out of the web path.

The bag is then pushed by a pusher bar into a carrier mechanism which, at the same time, spreads sides of the bag to open the unsealed end of the bag. The picker and pusher thus form means conveying the bag to the carrier mechanism which transports it along the predetermined path or run past the article insertion station. The carrier mechanism is formed of parallel, horizontally disposed endless chains or belts each of which has a number of outwardly extending lugs. The chains are continuously motor driven in unison to move the lugs along with them. As the bag is pushed into the carrier, it is engaged between a set of lugs and transported along the carrier path past the article insertion station. The lugs are spaced in the direction of chain movement somewhat less than the bag length to squeeze the bag edges together slightly and further open the unsealed end of the bag. The article to be shipped may now be readily inserted, either manually or automatically, into the open bag as it moves past the insertion station.

As the now filled bag reaches the end of the carrier run, its open, unsealed end moves into registry with a sealing means which closes and seals the open bag. The sealing means may be a belt type heat sealer where the bag is provided with heat responsive plastic or adhesive at its open end although other types such as staplers, etc., maybe used as desired.

The operating cycle of the preferred apparatus is controlled by a motor driven cam line which is readily adaptable to different size bags.

The filled, sealed bag is now ready for mailing, shipping, or other distribution, the only manual operation employed being insertion of the article in the already opened bag, and even this step is readily capable of automation. Not only is the need for manual operation reduced, if not eliminated entirely, but the overall bagging operation is performed more rapidly than with the manual processes heretofore employed.

DESCRIPTION OF THE DRAWINGS

The foregoing and other objects, features, and advantages of the invention will become more apparent from the following detailed description of a preferred embodiment which is intended to illustrate and not to limit the invention, taken in conjunction with the accompanying drawings, in which.

DESCRIPTION OF THE PREFERRED EMBODIMENT

Figure 1:
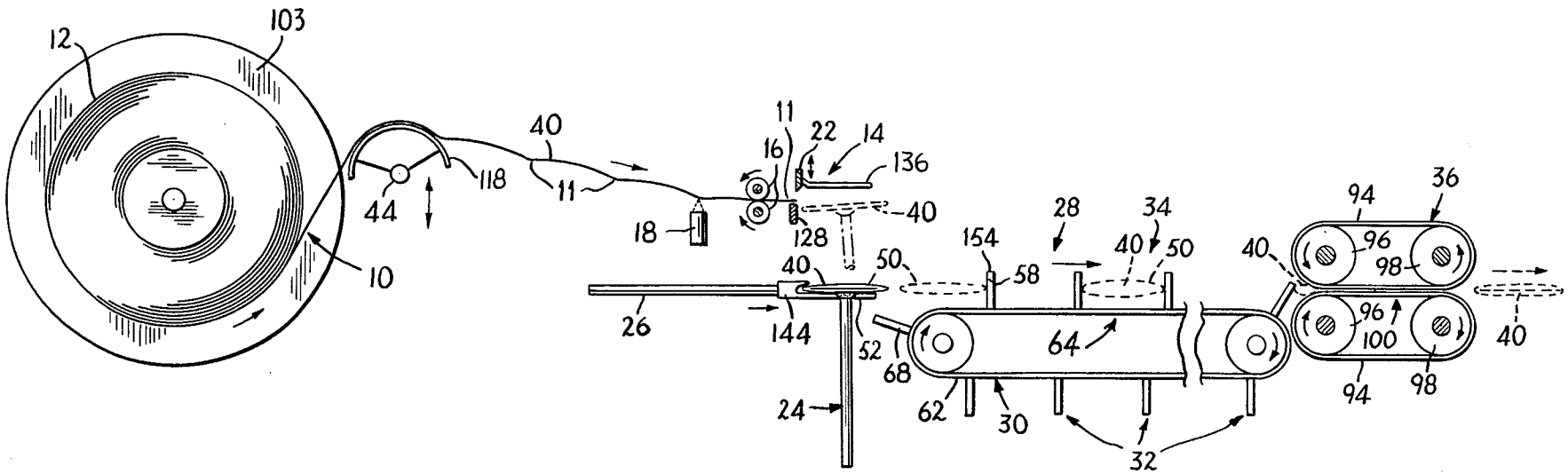
FIG. 1 is a plan view of various portions of the embodiment showing their arrangement relative to each other.

FIG. 1 shows the general arrangement of the preferred embodiment. A web or strip 10 of bags joined at successive, closed sides 11 of the bags is advanced from a rolled portion 12 of the web to a cutting station at 14 by a pair of nip rolls 16. A photocell 18 is positioned between the rolled portion of the web and the nip rolls for detecting an index mark 20 (FIG. 3A) on each bag of the web and then stopping the nip rolls with a side 11 of the preceding bag registered at a knife 22 in the cutting station.

A line of rotary cams (not shown) then controls cylces of operation of the embodiment. The cams first actuate the knife 22 to sever the bag at the cutting station. Then they retract a picker 24 from the path of the web in the cutting station to a position between the pusher bar 26 and carrier mechanism at 28.

The pusher bar then moves linearly to push the bag from the retracted picker into the carrier mechanism and open the unsealed top end of the bag. The carrier has endless, moving chains 30 (only one shown in FIG. 1) which advance outwardly extending lugs at 32 in unison, along a predetermined path or run, and past an article insertion station at 34 on the path. Successive lugs are spaced along the run slightly less than the length of the bag so that a bag, pushed into the carrier by the pusher bar, is squeezed between successive lugs to bow-out the sides and further open the top end of the bag as it is transported through the article insertion station by the lugs. Articles are then easily inserted in the bag at the insertion station.

The filled bag then reaches an end of the carrier where its open, unsealed end registers with sealing means at 36 for closing and sealing the open end of the bag. The sealed, article containing bag is now ready for shipping or other use.

MORE DETAILED DESCRIPTION

The preferred embodiment is illustrated in greater detail in FIGS. 2A–2C and FIGS. 3A–3C. These figures show the web 10 of bags and its rolled portion 12. The bags of the web are shown in further detail in FIGS. 5 and 6 and are also described in the above-identified patent applications. The web 10 has portions 11 at uniform intervals along its length which are connected, sealed sides of successive bags. Each bag has an outer layer 37 of paper or the like laminated to an inner layer 38 of foamed plastic. The laminated layers 37, 38 are folded about a bottom edge 39 to form, together with the sealed sides 11, the successive bags comprising the web. Each bag then has but one top end 40 on an edge of the web which is unsealed and through which an article may be inserted in the bag when the end is opened by separating opposite sides 41, 42 of each bag. Beads 43 of thermoactivatable adhesive extend along facing, opposite sides of the bag at the end 40 for later sealing the end. Index marks 20 are uniformly spaced along one side of the web at intervals corresponding to the length of each bag which is delimited by the sealed sides 11.

A first portion of the apparatus shown in FIGS. 2A, 2B, 3A and 3B advances the web of bags from the rolled portion 12 to the cutting station at 14 where individual bags are severed from the web. A dancer at 44 (FIGS. 2A and 3A) swings through a limited arc into engagement with the web to draw a supply loop from the rolled portion 12 of the web and then returns to its original position to leave the loop. The web passes between the pair of nip rolls 16 (FIGS. 2B and 3B) which then rotate to advance a portion of the web from the supply loop to the cutting station. The photocell 18 between the dancer and the nip rolls detects the index marks 20 on the web to stop the nip rolls when they have advanced just one, next bag 50 of the web into the cutting station. The knife 22 then cuts the bag 50 from the web.

Figure 2A:
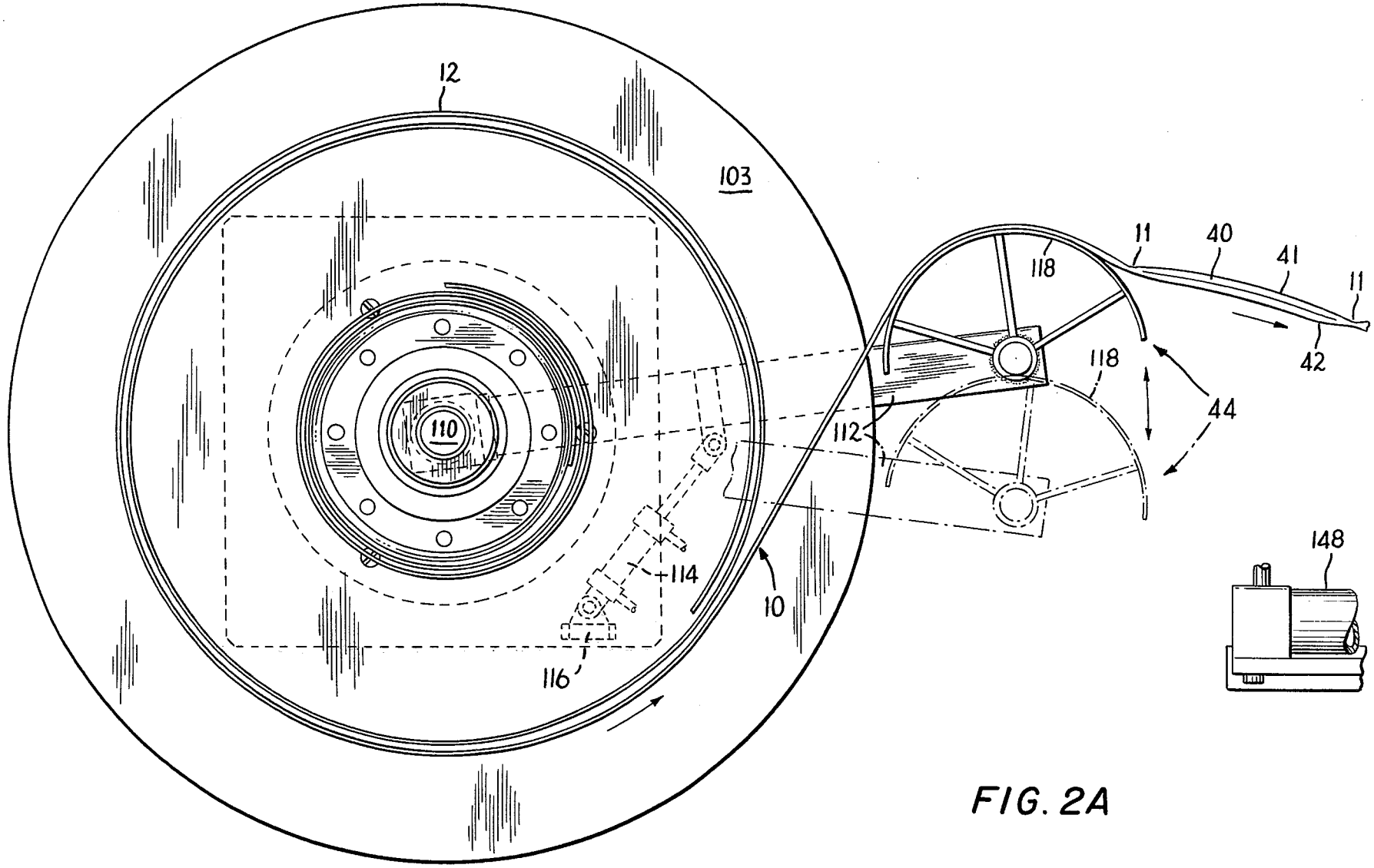
FIGS. 2A–2C are overall plan views of the embodiment.
Figures 2B, 8:
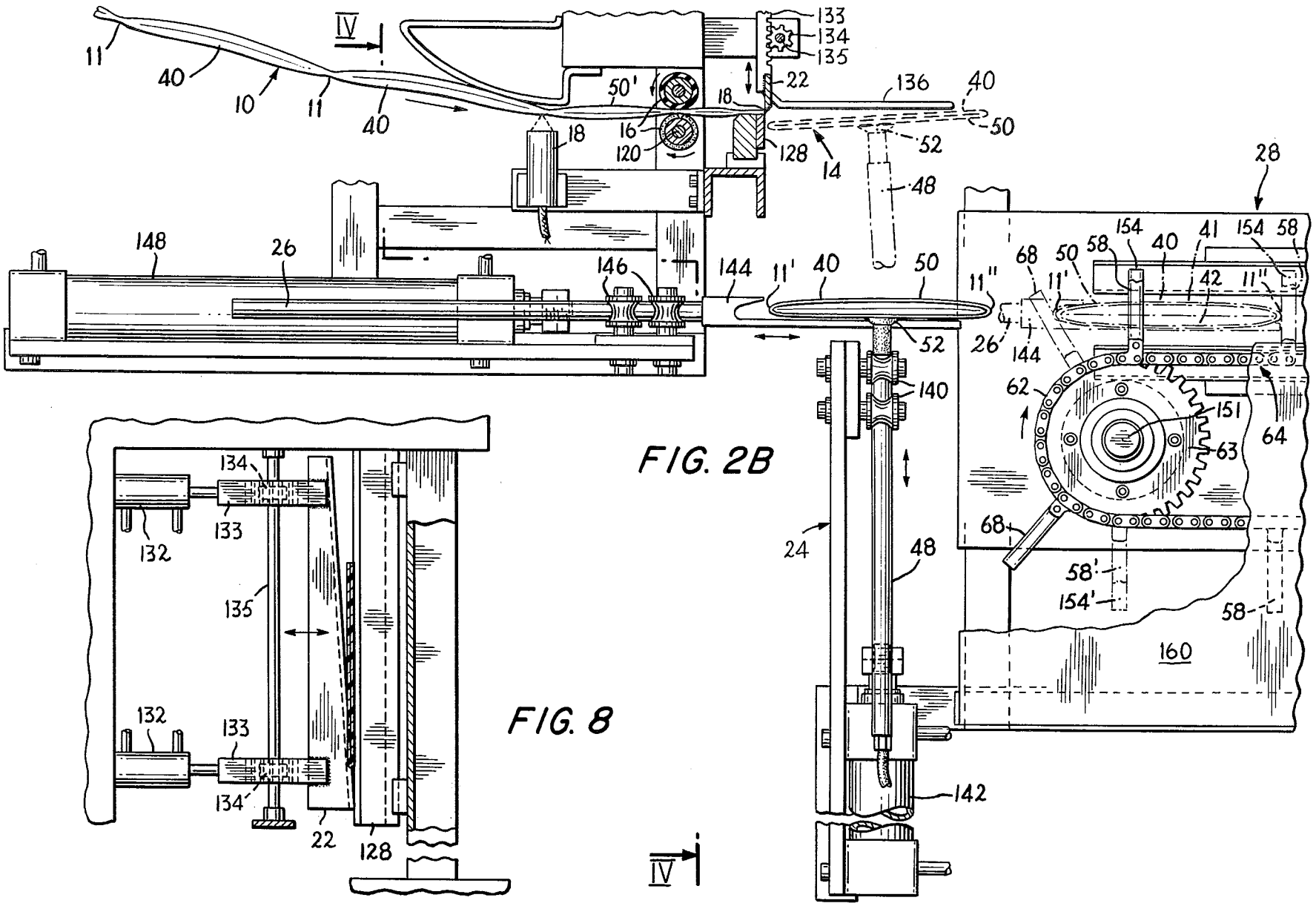
FIG. 8 is an elevation of a knife moving mechanism of the embodiment, which mechanism is partly shown in FIGS. 2B, 3B, and 4.

As best shown in FIG. 2B, a movable picker shaft 48 of picker 24 has advanced into the cutting station to engage the bag 50 with suction devices 52 on an end of the picker when the nip rolls advance the bag 50 into the cutting station. The picker then retracts and the suction devices convey the bag to a position out of the web path in which the bag is between the pusher bar 26 and carrier mechanism at 28. The pusher bar then moves to engage one of the closed sides, 11′, of the bag which was severed from a portion 11 of the web by the knife 22. Continued movement of the pusher advances an opposite side 11″ of the bag into engagement with one lug 58 (and later described lug 154) of the lugs at 32 (FIG. 1) in the carrier at 28.

In the carrier mechanism, the lug 58 is mounted on one chain 62 of the chains 30 (FIG. 1) which advances the lug about a sprocket 63 and along a predetermined path or run 64. The pusher bar 26 advances the bag into the carrier at a speed such that the edge 11″ of the bag 50 remains in engagement with the lug 58 as the lug initially advances along the chain run. Another carrier lug 68 on another chain 70 (FIG. 3B) advances about a sprocket 72 (FIG. 3B) which rotates coaxially with the sprocket 66. The lugs 58, 68 are positioned relative to each other such that the lug 68 advances into engagement with the side 11′ of the bag as it enters in the run 64. The lug 68 then advances along the run 64 in unison with the lug 58 to move or transport the bag 50 along the chain run between the lugs. The side 11'' is therefore a leading edge of the bag 50 relative to its movement along the chain run, while the side 11' is a trailing edge. The lugs 58, 68 are spaced along the run 64 slightly less than the length of each bag delimited by the successive sealed sides 11. Engagement of the trailing edge of a bag by the lug 68 then squeezes or compresses the bag between the lugs 58, 68. This compression of the bag bows the opposite sides 41, 42 of the bag outwardly to further open the end 40 of the bag from its already opened condition described with reference to the pusher bar 26. As the opened bag is then carried along the chain run 64, articles may be inserted in the bag at the insertion station 34 along the run 64.

Figure 2C:
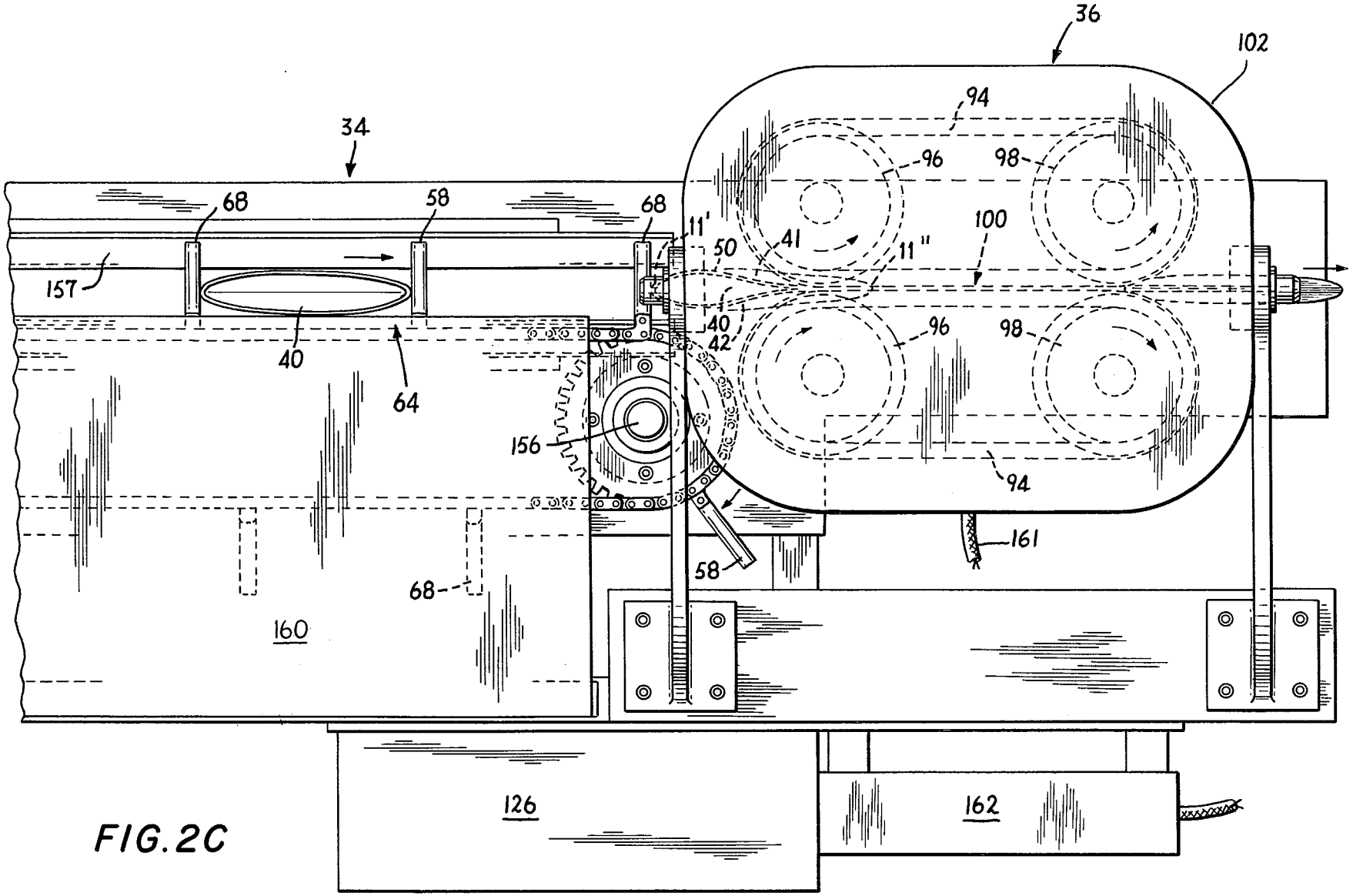
Figures 3A, 5, 6:
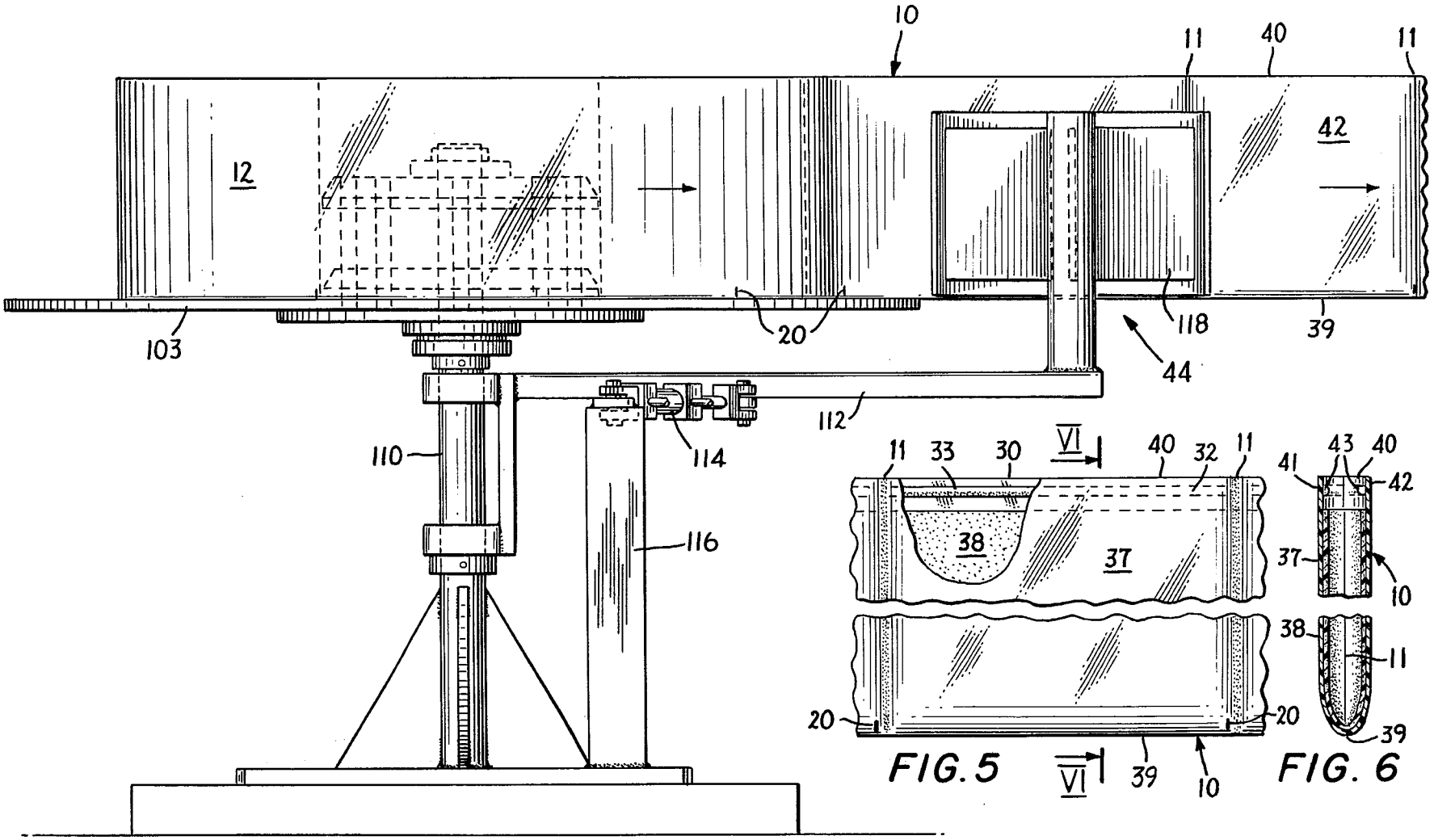
FIGS. 3A–3C are overall front views of the embodiment shown in FIG. 2.
FIG. 5 is an elevation, partly in section, of a portion of a web of bags shown in FIGS. 2A and 3A.
FIG. 6 is an end, section view of the portion of the web of bags taken along a line VI—VI in FIG. 5.
Figure 3B:
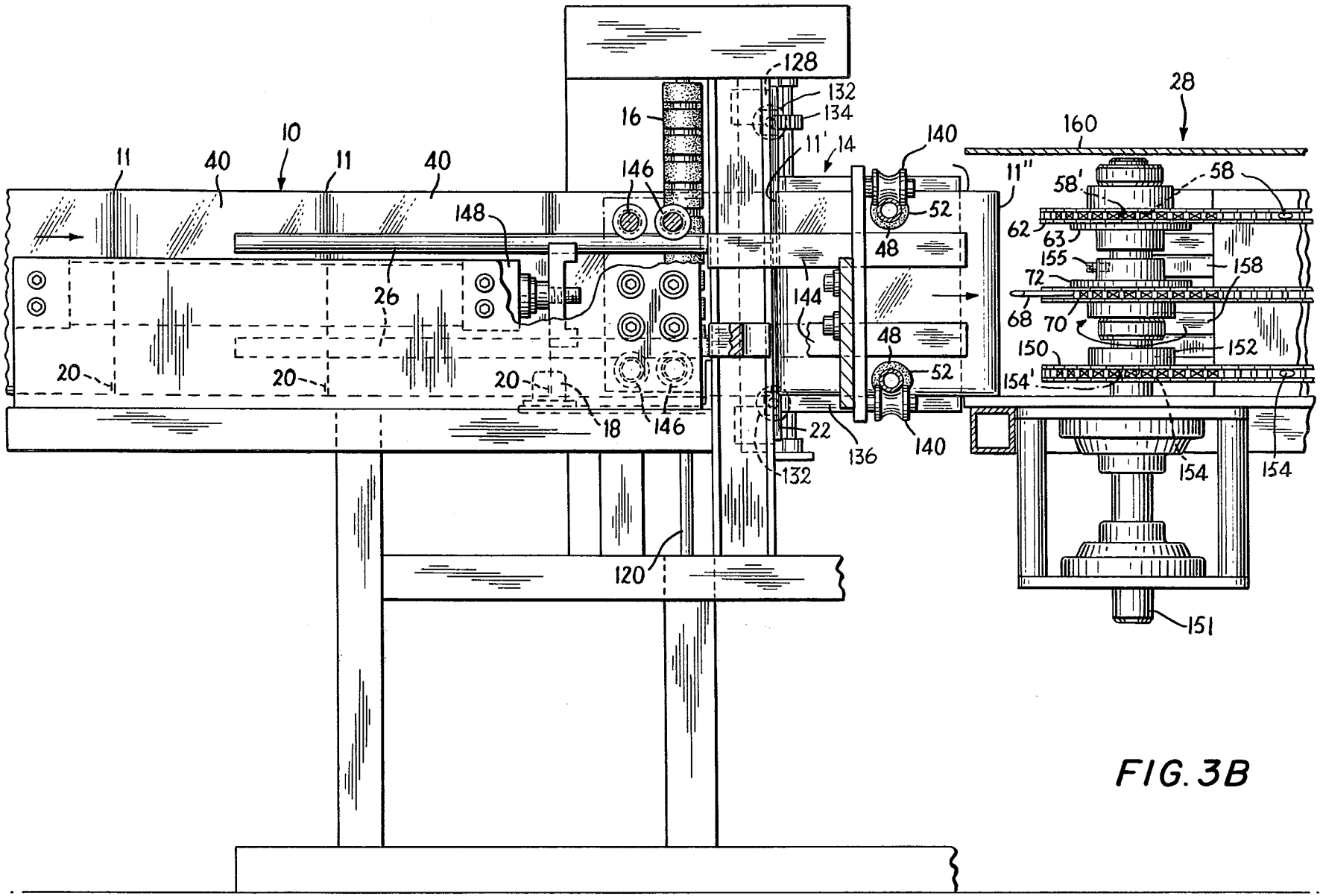
Figure 3C:
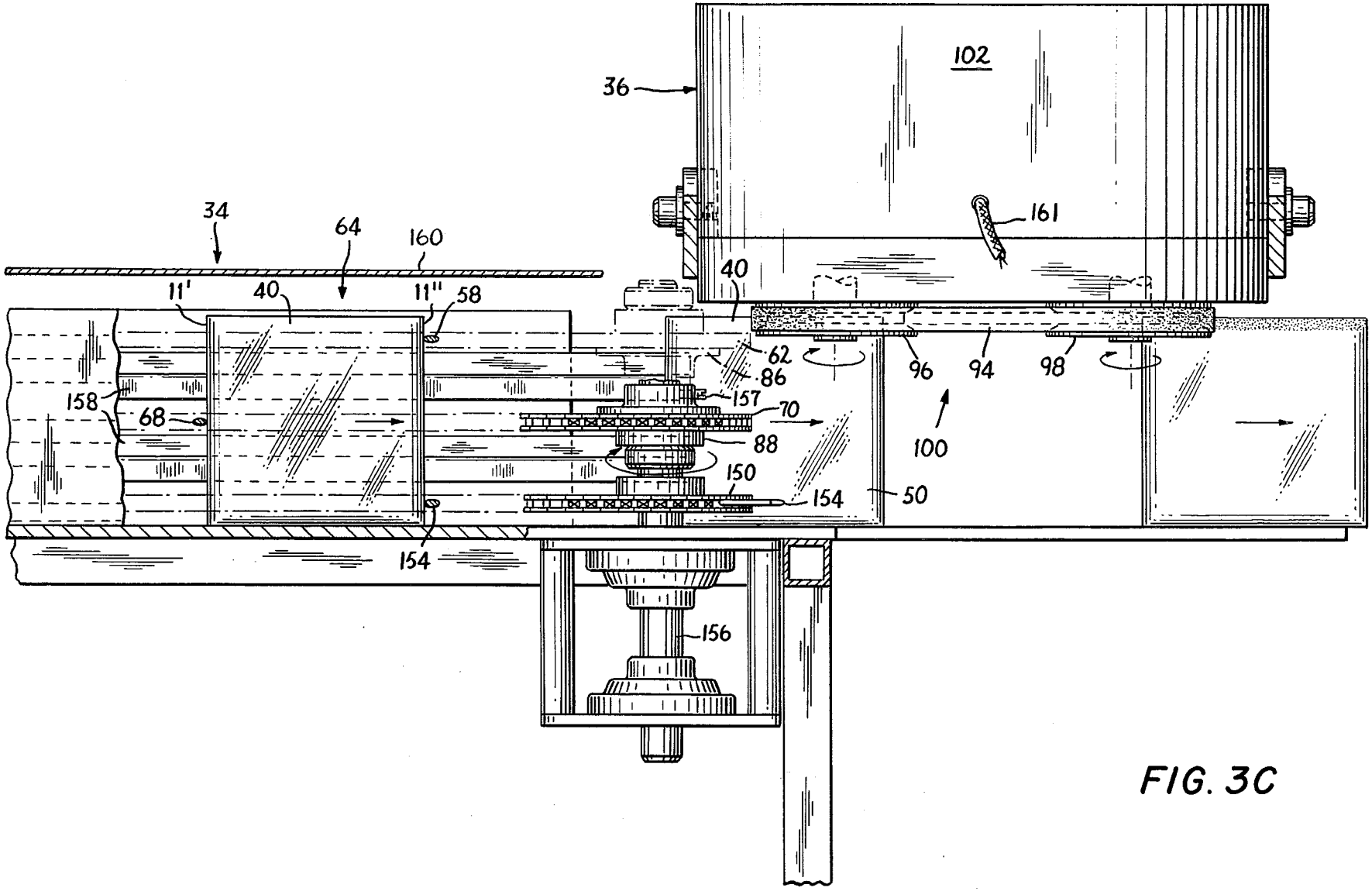

FIGS. 2C and 3C show the bag 50 in a different position at the end of the run 64. Sprockets 86, 88 are in driving engagement with the chains 62, 70 at the end of the run. As the carrier lug 58 at the leading edge 11'' of the bag is carried about sprocket 86 and away from the leading edge of the bag, the lug 68 continues to push the trailing edge 11' to advance the bag from the chain run 64 into the means at 36 for sealing the opened end 40 of the bag.

The sealing means has a pair of belts 94 each driven by a continuously operating motor 97 (FIG. 7) about belts wheels 96, 98 and along opposite sides of a belt run 100. The belt run extends in alignment with the run 64 and is positioned to press together opposite sides of the bag adjacent the opened end 40. The belts 94 progress along the belt run at a speed enough faster than the speed at which bags are advanced along the chain run 64 so as to smoothly engage each portion of the opposite sides 41, 42 of each bag and advance the bag clear of lug 68 as it moves about sprocket 88. Heating means 101 (FIG. 7) are mounted in a housing 102 extending over the belt run. The heating means activate the adhesive 43 (FIG. 6) on the inside, facing surfaces of the sides of the bags adjacent the opened end 40 to seal the bags when the sides are pressed together in the belt run.

Web Advancing Means and Cutting Station

A table 102 which supports the rolled portion 12 of the web of bags is shown in FIGS. 2A and 3A to be mounted for free rotation on a shaft 110. The dancer at 44 has an arm 112 also mounted at one end for free rotation on the shaft 110. A piston and cylinder device 114 is pivotably connected at one end to the arm 112 and at the other end to a frame 116. Movement of the piston and cylinder device from a contracted to an expanded condition then swings the dancer through a limited arc about the shaft 110 from a first position shown in phantom in FIG. 2A to a second position shown full in the Figure.

An end of the arm 112 opposite that mounted on the shaft 110 extends beyond the table 102 and carries an upstanding member having an arcuate face portion 118. During movement of the dancer through its limited arc, the face portion 118 engages the web 10, the free end of which is held between the nip rolls 16, so that movement of the dancer draws a section of the web from the rolled portion 12 to form the supply loop about the face portion 118, the table 103 rotating with the web to unroll the section of the web for the loop. The dancer then returns to its original position to leave the supply loop in the web.

Figure 7:
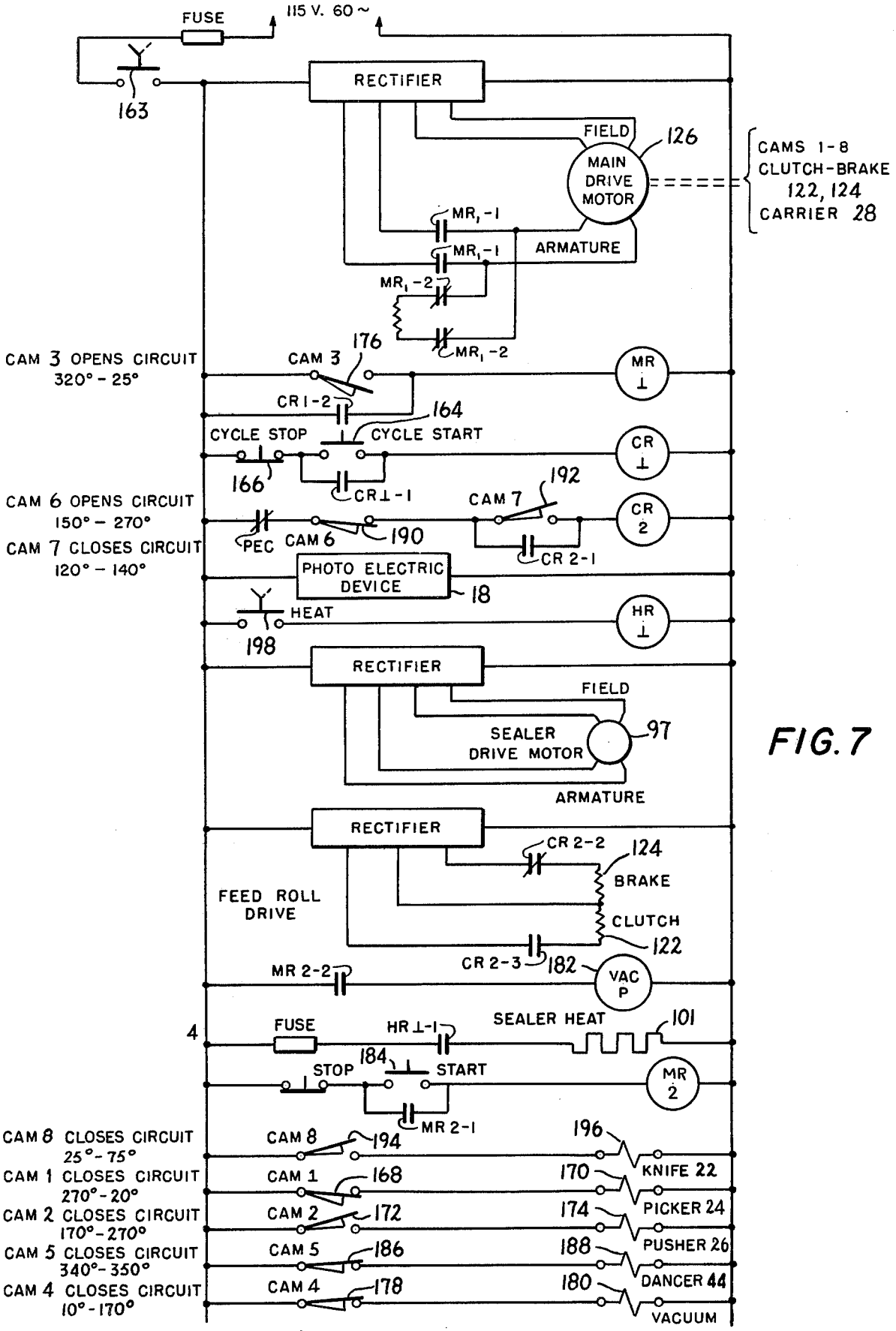
FIG. 7 is an electrical schematic of the embodiment.

The nip rolls 16 shown in FIGS. 2B and 3B then rotate to advance the web from the supply loop to the cutting station at 14. The nip rolls are rotatably driven in unison by shafts 120. A clutchbrake 122, 124 (FIG. 7) operatively connects the roll drive shafts 120 to a main drive motor 126 (FIG. 7). In an alternative embodiment (not shown), the nip roll drive shafts may be driven by a motor and servo drive system described in copending U.S. patent application Ser. No. 481,918 filed 21, 1974, now U.S. Pat. No. 3,948,425, in the name of John L. Bala, said application being a continuation-in-part of copending U.S. patent application Ser. No. 382,319 filed July 25, 1973 in the name of John L. Bala, now abandoned.

The photocell 18 provides a signal for operating the brake 124 (FIG. 7) to stop rotation of the nip rolls. The photocell is positioned between the dancer 44 (FIG. 2A) and the nip rolls 16 for detecting the index marks 20 on the web and stopping the nip rolls 16 with the brake 124 (FIG. 7) when the nip rolls have advanced a next bag side 11 to the knife 22 in the cutting station 14. To accommodate differing intervals between the index marks 20 on different webs of bags, the photocell 18 is mounted on the apparatus by means (not shown) for positioning the photocell along the web relative to the knife 22. In an alternative embodiment, the photocell is fixed relative to the knife, but the index marks 20 on all webs for use in the embodiment are a uniform interval from a preceding bag side 11 on the web to be stopped at the knife.

The cutting station 14 comprises a fixed cutting bar 128 which is secured to a frame of the apparatus. The cutting knife 22 is connected at each end to piston and cylinder devices 132 for moving the knife 22 into cooperative web-cutting engagement with the bar 128 for cutting the web 10 at the portion 11 which was positioned at the knife by the photocell 18. The bag 50 is then severed from the web.

To assure synchronized, coordinate action of the piston and cylinder devices 132, FIG. 8 shows that the piston of each device carries a rack 133 each of which engages a pinion 134 on a common shaft 135 which is freely rotatable in a frame of the apparatus. Since the pinions must rotate together on the common shaft, the racks and connected pistons must advance together in synchronism with each other. The knife 22 also has a backing plate 136 which extends normally to the cutting movement of the knife. The backing plate 136 engages the bag 50 as it is cut from the web by the knife to press and hold the bag against the extended picker 48.

The Conveying Means

As shown in FIGS. 2B and 3B, the movable part 48 of picker 24 has a pair of tubular suction devices 52 mounted on rollers 140 for movement substantially parallel to the cutting movement of the knife 130 which is generally normal to the path of the web of bags in the cutting station. A piston and cylinder device 142 is connected to the picker 48 to advance the suction devices between the rollers 140 to an extended position engaging a side of the bag 50 opposite that engaged by the backing plate 136 in the cutting station. The suction devices 52 carry the bag 50 with them when the piston and cylinder device 142 retracts the picker 48 from the position shown in phantom to the position shown in full in FIG. 2B. In practice, and as more accurately shown by the picker portion 48 in phantom in FIGS. 1 and 2B, the picker 24 preferably is canted at a slight angle of say 5°–10° from the perpendicular to the backing plate 136 and the path in the carrier mechanism 28 so that the newly cut edge 11' of the bag is pulled forward of and slightly away from the cutter bar 128 and into a position to be more positively engaged by the later described yoke 144 on the pusher bar 26. With the picker 48 in the retracted position, the bag 50 is positioned between the pusher bar 26 and the chain run 64 in the carrier.

The pusher bar 26 is mounted on rollers 146 and connected at one end to a piston and cylinder device 148 for moving the pusher generally normal to the movement of the knife 22 and toward and away from the chain run 64. The yoke 144 on the other end of the pusher bar is configured for engagement with the side 11' of the bag 50 when the yoke moves toward the run. The movement of the pusher bar 26 then pushes the bag 50 from the picker 48 into engagement with a lug in the chain run of the carrier. The pushing engagement of the bag between the pusher bar and lug compresses the bag to bow-out its opposite sides for opening the unsealed end 40 of the bag. The vacuum of the suction devices 52 is preferably cut off simultaneously with the movement of the pusher bar to permit the pusher to freely advance the bag into the carrier. The picker and pusher bar thus cooperate to convey the bag from the cutting station to the carrier mechanism.

The Carrier Mechanism

The carrier mechanism is best seen in FIGS. 2B, 2C, 3B, and 3C. FIGS. 3B and 3C show sprockets 63, 72 mounted on a shaft 151 and sprockets 86, 88 mounted on a shaft 156 for rotation with each other. A third chain 150 is carried along the run 64 by sprockets 152, 154 which are mounted on shafts 151, 156 for coaxial rotation in unison with the earlier described sprockets 63, 72 and 87, 88, respectively. The chain 150 has a lug 154 in spaced alignment with the lug 58 on chain 62. The lugs 58 and 154 thus both engage the leading edge 11'' of the bag 50 to more firmly hold the bag in its compressed, opened condition between the lugs 58, 154 and the lug 68. The lugs 58 and 154 are respectively positioned above and below the yoke 148 to avoid contact with the yoke should the leading edge 11'' of the bag 50 collapse sufficiently upon engagement with the lugs to permit the yoke to approach the lugs. The lug 68 is positioned intermediate upper and lower portions of the yoke 148 to permit the lug 68 to engage the trailing edge 11' of the bag without interference from the yoke.

The chains 62, 70, and 150 are each shown to have additional lugs 58', 68', and 154' spaced along the chains. These lugs function during succeeding cycles of the apparatus with the bags then cut from the web exactly as described for the lugs of corresponding reference character with bag 50. No further description is therefore necessary. Lugs 58, 154 or 58', 154' thus always engage a leading edge of a bag advanced into the carrier by the pusher bar 56 while the lugs 68 ro 68' always engage a trailing edge of the bag.

Sprockets 72, 88 carrying the chain 70 may be released from rotation in unison with the sprockets 63, 86, 152, and 154 by loosening set screws 155, 157, and rotated relative to the other sprockets to position the lugs 68, 68' relative to the lugs 58, 58', 154, and 154'. The lugs 68, 68' are spaced from the lugs 58, 154 and 58', 154' in the run 64 a distance slightly less than the length of the bags to compress the bags between the lugs. Since all the bags forming a web have the same length, rotating the sprockets relative to each other positions the lugs 58, 68 and 154 for one bag on the web and the carriers 58', 68' and 154' for each of the other bags of the web. Having once positioned the lugs for the bags of one web, the set screws are tightened for rotating the sprockets in unison.

Each of the sprockets 86, 88, and 154 is then secured to the shaft 156 which is operatively connected to the main drive motor 126 by drive means (not shown). The sprockets 86, 88, and 154 then pull the chains 62, 70 and 150 along the run 64 from idler sprockets 63, 72 and 152. The chains thus continuously progress in unison along the run 64 with operation of the drive motor at a speed controlled by the speed of the main drive motor.

Figure 4:
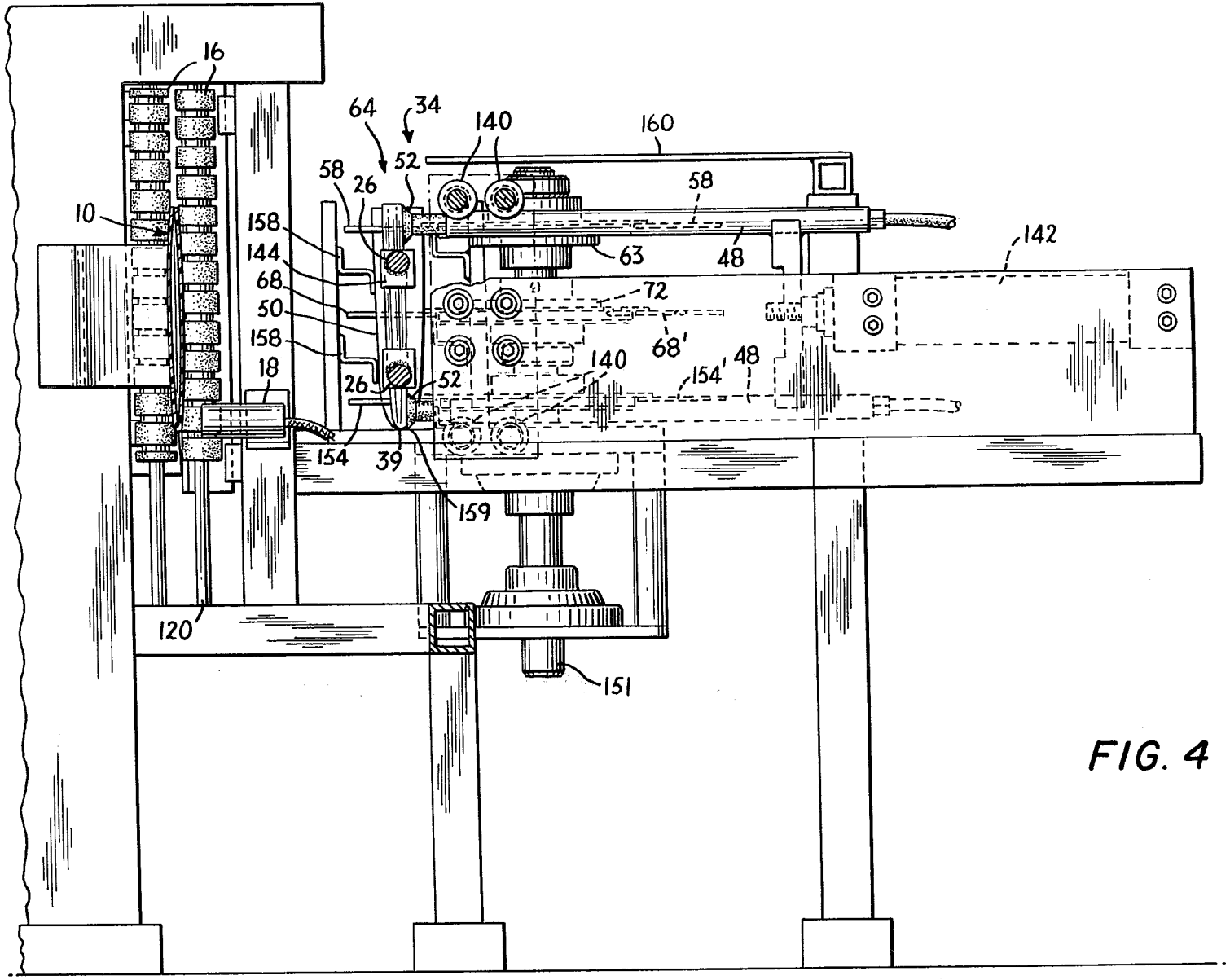
FIG. 4 is an end view of a portion of the embodiment shown in FIGS. 2B and 3B.

As shown in FIG. 4, the carrier additionally has guide rails 158 and a support plate 159 mounted on a frame of the apparatus. The guide rails extend along the run 64 on an opposite side of the bag 50 from the chains to keep the bag from rotating out of engagement with the lugs. The guide rails are sufficiently spaced from the chains to accommodate the width of the bag in the opened condition in which it is held by the lugs. The plate 159 slidingly supports the bottom 39 of the bag to hold the bag in the carrier. A table 160 covers the carrier at the run 64 to form the article insertion station 34 in the carrier. Articles are then stored on the table and manually slid from the table into an open bag in the adjacent path or run 64 as desired.

The Sealing Means

Each bag is pushed from an end of the carrier run 64 at sprockets 86, 88, 154 by a lug 68, or 68' at a lower speed than it is drawn into the belt run 100. Each portion of the sides 41, 42 of the bag adjacent the opened end 40 is thus smoothly engaged by the belts 94 without any bunching or jamming resulting from pushing the bags into the belt run faster than the bag is progressed along the belt run and the bag is advanced away from lugs 68, 68' to permit them to freely swing about sprocket 88 without hitting the bag.

The heating means 101 (FIG. 7) in the housing 102 of the sealing means 36 may be any number of known types, for example an electrically operated radiant heating unit supplied with power through a cord 161. The intensity of heat from the heating means is such in relation to the time during which a bag progresses through the belt run 100 that the adhesive 43 (FIG. 5) on the opposite, facing, inside surfaces of the bag adjacent the opened end 40 is activated while the opposite sides of the bag are pressed together by the belts to seal the opened end 40 of the bag. In an alternative embodiment, the adhesive may be replaced by the foamed plastic lining 38 (FIG. 5) of the bags which, when heated, may have sufficient adhesive properties to seal the bags. The sealed bags are then discharged from an output end of the belt run 100 for mailing.

Control and Operation

The main drive motor 126 is operatively connected to a set or line of rotary cams (not shown) in a housing 162 shown in FIG. 2C. Each of the cams operates an electrical switch shown in schematic FIG. 7. To operate the described apparatus, a main switch 163 is closed to provide electrical power to the control. However, the main drive motor 126 does not immediately start because motor relay contacts MR1-1 open the motor armature circuit while normally closed motor relay contacts MR1-2 shunt the armature. A normally open cycle start switch 164 is then closed to supply power to control relay CR1. Control relay contacts CR1-1 then close to latch the apparatus in operation until later stopped by opening a normally closed stop switch 166.

Control relay CR1 also closes control relay contacts CR1-2 to provide power to motor relay MR1. Motor relay MR1 then closes contacts MR1-1 and opens contacts MR1-2 to start the main drive motor 126. As before described, the main drive motor 126 is operatively connected to continuously drive the chains along the run 64. However, no bags are yet present on the run.

The main drive motor is also connected to the line of cams in housing 160 (FIG. 2C). Each of these cams starts from an initial position of approximately 0° rotation relative to a frame of the apparatus; specifically, each cam is in a range from 320° to 25° rotation relative to the frame. Each cam is driven by the main drive motor 126 coincidentally with the other cams.

With the cam line in the initial position, a first cam has closed a cam switch 168 which then provides electrical power to solenoid valve or electrically operated fluid pressure switch 170. Valve 170 then provides pressure fluid from a source (not shown) to piston and cylinder device 142 to advance the picker 24 to the cutting station at 14 as shown in phantom in FIG. 2B. Valve 170, like each of the later described solenoid valves, has a spring or similar actuator to throw the valve when electrical power is cut off as by opening cam switch 168.

In the initial cam position a second cam has opened a normally closed cam switch 172 to open circuit a solenoid valve 174. Valve 174 then provides fluid pressure from the source to the piston cylinder device 148 (FIG. 2B) to retract the pusher bar 26 to the position away from the run 64 (FIG. 2B).

Also in the initial position, a third cam has not closed a normally open cam switch 176 which, when closed, provides electrical power to the motor relay MR1. However, the motor relay is already energized through the control relay contact CR1-2 as previously described. Cam switch 176 is thus ineffective during this portion of the cycle of operation of the apparatus.

A fourth cam does not open a normally closed switch 178 while the cams are in their initial position. The cam switch 178 then provides electrical power to solenoid valve 180. Valve 180 is then effective to provide a vacuum to each of the suction devices 53 (FIG. 2B) of the picker. The vacuum is provided by a motor operated vacuum pump 182 which receives electrical power by closing normally opened motor relay contacts MR2-2. These contacts are closed by momentarily closing a vacuum start swtich 184 to provide power to a motor relay MR2. The motor relay MR2 then closes motor relay contacts MR2-1 to latch the motor relay in its energized condition in which it closes the motor relay contacts MR2-2 for operating the vacuum pump 182.

In the initial position of the cams, a fifth cam does not open normally closed cam switch 186 which then provides power to a solenoid valve 188 which provides pressure from the source to operate the piston and cylinder device 114 (FIG. 2A) to swing the dancer at 44 to the position shown in full in FIG. 2A. With the dancer in its advanced, initial position, a supply loop is drawn from the web 10 to be later advanced between the nip rolls 16 into the cutting station 14 (FIG. 2B).

The initial position of a sixth cam closes a normally open cam switch 190. However, the cam switch 190 is ineffective during this portion of the cycle of operation of the apparatus because a seventh cam opens a normally closed cam switch 192 which is in series with the cam switch 190. Normally open control relay contacts CR2-1 which shunt the cam switch 192 to latch a control relay CR2 in its energized condition remain open unitl the cam switch 192 closes to initially energize the control relay CR2.

With the control relay CR2 opened-circuited, normally closed control relay contacts CR2-2 remain closed to provide electrical power to the brake 124. The brake then holds the nip rolls 16 (FIG. 2B) against rotation while the dancer draws the supply loop in the web.

An eighth cam does not open a normally closed cam switch 194 while in its initial position. The switch 194 then provides electrical power to a soldnoid valve 196 which provides fluid pressure from the source to the piston and cylinder devices 134 (FIG. 2B) to move the cutting knife 22 away from the cooperative cutting bar 128.

FIG. 7 also shows a switch 198 which is manually closed to provide power to heater relay HR1. The heater relay then closes contacts HR1-1 to provide electrical power to the heater 101 in the sealing means 36 (FIG. 2C). The switch 198 remains closed until later opened. Operation of the power switch 162 also provides electrical power to the photocell 18 which, when not detecting a mark 20 (FIG. 3B) on the web, leaves closed normally closed photocell contacts PEC.

The described position of the apparatus at the start of a cycle of its operation thus corresponds to relative positions of the apparatus shown in FIG. 1. The number of cycles of operation of the apparatus between starting and stopping is determined by the time of operation of the cycle stop switch 166 after the operation of the cycle start switch 164.

As the main drive motor 126 rotates the cams from their initial position, the fifth cam opens the cooperative cam switch 186 to release the valve 188. Fluid pressure from the valve 188 then operates piston and cylinder device 114 (FIG. 2A) to retract the dancer at 44 to the position shown in phantom in FIG. 2A. The dancer then leaves the supply loop in the web for freely advancing to the cutting station 14 (FIG. 2B) between the nip rolls.

Continued rotation of the cams to approximately 120° causes the seventh cam to close its cooperative cam switch 192 thereby providing electric power through the normally closed photocell contacts PEC and cam switch 190 to control relay CR2. The control relay then closes normally open control relay contacts CR2-1 to latch control relay CR2 in its energized condition until the photoelectric contacts PEC or the switch 190 opens. Control relay CR2 also opens normally closed relay contacts CR2-2 to release the brake 124 and closes normally open relay contacts CR2-3 to engage the clutch 122. The clutch 122 then couples the main drive motor 126 to the nip roll drive shaft 120 (FIG. 2B) to rotate the nip rolls to advance the web from the supply loop formed by the dancer into the cutting station. The nip rolls 16 are arranged to feed at least the length of web between successive portions 11 (FIG. 2B) before the main drive motor rotates the cams to 150° from their original position. The photocell 18 should then detect an index mark 20 (FIG. 3B), one of which is positioned for detection over the length of each bag comprising the web.

The photocell responds to detection of an index mark 20 by opening the normally closed photocell contacts PEC. The photocell contacts then open circuit the control relay CR2 to again close the contacts CR2-2, apply the brake 124, and stop the nip rolls and to again open the contacts Cr2-3 to disengage the clutch 122 which had been driving the nip rolls, it being recalled that the photocell is positioned to stop the nip rolls when a next web portion 11 (FIG. 2B) is registered with the knife for severing one bag, for example the bag 50 (FIG. 2B), from the web. If, due to some malfunction, the photocell does not detect a mark before the main drive motor rotates the cams to 150° from their original position, the sixth cam opens cooperative cam switch 190 to open circuit the control relay CR2. As just described, open circuiting the control relay CR2 stops the nip rolls. The sixth cam thus serves as a safety device to prevent the nip rolls from continuously feeding the web into the cutting station.

When the main drive motor 126 further rotates the cams to 270° from their original position, the first cam closes cooperative cam switch 168 to provide electric power to the valve 170. Valve 170 then operates piston and cylinder device 142 (FIG. 2B), to extend the picker to the cutting station and into engagement with the bag 50 just advanced into the cutting station by the nip rolls. The picker remains extended as the main drive motor rotates the cams through 360°, back to their original position, to begin a second cycle of the operation of the apparatus. Unless stopped by switch 166, the main drive motor continues to operate through the second cycle because the control relay CR1 is latched on by control relay contacts CR1-1.

As the cams are rotated to 10° of the second cycle, the fourth cam closes cooperative cam switch 178 to cause fluid pressure switch 180 to apply the vacuum from pump 182 to the suction devices 52, (FIG. 2B) to hold the bag 50 on the picker then in the cutting station.

Continued rotation of the cams to about 25° causes the eighth to close cooperative cam switch 194 to provide electric power to the valve 196. Valve 196 then provides fluid pressure to the piston and cylinder devices 134 (FIG. 2B) to move the knife 22 into cooperative, web-cutting engagement with the cutter bar 128 which severs the bag 50 from the web at a portion 11 of the web positioned at the knife by the photocell as shown in FIG. 2B.

Just before and during the severing of the bag 50 from the web, specifically after about 20° rotation of the cams, the first cam opens cooperative cam switch 168 to cause valve 170 to retract the picker to convey the bag to the position shown in full in FIG. 2B.

Continued rotation of the cams to about 170° causes the fourth cam to open cooperative cam switch 178 thereby causing valve 180 to cut off the vacuum to the suction devices. At about the same 170° rotation of the cams, the second cam closes cooperative cam switch 172 to cause valve 174 to provide fluid pressure for extending the pusher bar 26 (FIG. 2B) into engagement with the bag. The pusher continues to push the bag into the chain run 64 (FIG. 2B) of the carrier, the bag being released from the picker by the cut-off of the vacuum and partly opened by the pushing engagement between the pusher bar and lugs in the carrier.

The chains of the carrier are continuously driven by the main drive motor to advance the lugs along the chain run as earlier described, it being recalled that the carriers compress the bag between them to further open the bag as it is transported along the chain run past the article insertion station. The sealer drive motor 97 is also continuously operated to continuously advance the belts along the belt run 100 (FIG. 2C) to accept the bag 50 from the far end of the carrier. The sealing means then seal the bag as before described.

Continued rotation of the cams by the main drive motor then continues the operation of the apparatus earlier described with reference to the first cycle. A third and additional cycles of the apparatus then continue as described for the first and second cycle until the cycle stop switch 166 is opened. Opening the cycle stop switch open circuits control relay CR1 which, in turn, opens control relay contacts CR1-2. If the main drive motor has rotated the cams to 320° to 25° in a cycle of operation of the apparatus when the cycle stop switch is opened, the third cam opens cooperative cam switch 176 to open circuit the motor relay MR1. Opening the relay MR1 then returns the contacts MR1-1 and MR1-2 to the condition shown in FIG. 7 which stops operation of the main drive motor 126. However, if the main drive motor has rotated the cams to between 25° to 320° of a cycle of operation of the apparatus when the cycle stop switch is opened, the third cam has closed cooperative cam switch 176 to close the circuit to motor relay MR1. The motor relay MR1 then continues to hold the main drive motor 126 in operation until the motor rotates the cams to about 320° of the cycle when the third cam opens cam switch 176. Since opening stop switch 166 opened contacts CR1-2, opening switch 176 causes the motor relay MR1 to stop the main drive motor. Accordingly, operation of the cycle stop switch 166 always stops the apparatus at about 0° of cam rotation and, specifically, between 320° and 25° of cam rotation in which the various components of the apparatus assume the relative positions indicated in FIGS. 1 and 7.

I claim:

1. Bag handling apparatus comprising:

means for severing individual bags from a continuous web of bags;

carrier means engaging each bag severed from said web and transporting it along a predetermined path with an open end of each of said bags disposed for insertion of an article, said carrier means including pairs of spaced lugs for retaining respective ones of said severed bags while transporting them along said predetermined path;

means for conveying each bag severed from said web to said carrier means, said conveying means having means for pushing against one edge of a severed bag to bring the opposite edge of said bag to bear against the first lug of a pair of said lugs on said carrier means for opening said end of said severed bag, the other of said pair of lugs thereafter being brought to bear against said one edge of said bag to retain said bag in its opened condition while being transported along said predetermined path;

and means at an end of said predetermined path for sealing said open end of said bags.

2. Apparatus as in claim 1 wherein said severing means comprise a knife movable into engagement with said web for cutting said individual bags from said web, and a backing plate on said knife which presses and holds said bags against said conveying means as they are cut from said web.

3. Apparatus as in claim 1 wherein said pushing means in said conveying means comprises a pusher bar having a yoke and means reciprocating said yoke to push said one edge of each severed bag only into engagement with said first lug for cooperatively opening said end of said bag, said lugs of said carrier means thereafter transporting said bags and said yoke retracting for pushing a next one of said bags.

4. Apparatus for handling bags, comprising:

means for advancing said bags in a continuous web of bags connected at successive sides of said bags to a cutting station, each bag having an index mark uniformly spaced along said web, said means for advancing said bags having a dancer movable into engagement with said web for forming a supply loop in said web, means for moving said dancer, a pair of rotating nip rolls for advancing said web from said supply loop to a knife in said cutting station, said knife being movable for cutting said web, means detecting said index mark on each bag for stopping said nip rolls when they have advanced said connected sides of successive bags into registry with said knife, and means operative while said nip rolls are stopped for moving said knife to cut said web whereby an individual bag is severed from said web, and a backing plate on said knife for pressing one side of and holding said bag against a suction device when said knife cuts said web;

means for conveying said bag from said cutting station to carrier means, said conveying means having a picker having said suction device engaging a side of said severed bag opposite that pressed by said backing plate in an extended position and movable to a retracted position for moving said bag to said retracted position and away from said cutting station, means for moving said suction device, a pusher bar having a yoke movable into engagement with said bag in said retracted position of said suction device for pushing said bag from said suction device into engagement with said carrier means to open an unsealed end of said bag, and means for moving said yoke;

said carrier means for transporting said bag along a predetermined path, said carrier means having at least one first lug engaged by a leading edge of said bag when said bag is pushed into said carrier and movable along said predetermined path past an article insertion station, a second lug engaging a trailing edge of said bag in said predetermined path and movable along said predetermined path in unison with said first lug for transporting said bag along said predetermined path between said lugs, said lugs being spaced along said predetermined path less than the length of said bag to compress said bag between said lugs for opening said unsealed end of said bag while it is transported along said predetermined path past said article insertion station where articles may be inserted in said bag, and means for moving said lugs along said predetermined path;

and means receiving said bag from an end of said predetermined path of said carrier means for closing and sealing said open, unsealed end of said bag.

* * * * *